US007994928B2

(12) United States Patent
Richmond

(10) Patent No.: US 7,994,928 B2
(45) Date of Patent: Aug. 9, 2011

(54) MULTIFUNCTION SMOKE ALARM UNIT

(76) Inventor: Robert Charles Richmond, Yucaipa, CA (US)

( * ) Notice: Subject to any disclaimer, the term of this patent is extended or adjusted under 35 U.S.C. 154(b) by 601 days.

(21) Appl. No.: 12/151,958

(22) Filed: May 12, 2008

(65) Prior Publication Data

US 2008/0291036 A1 Nov. 27, 2008

Related U.S. Application Data

(60) Provisional application No. 60/931,896, filed on May 25, 2007.

(51) Int. Cl.
*G08B 17/10* (2006.01)

(52) U.S. Cl. ..... 340/628; 340/577; 340/541; 340/565

(58) Field of Classification Search ..... 340/628, 340/577, 541, 552, 561, 565
See application file for complete search history.

(56) References Cited

U.S. PATENT DOCUMENTS 3,613,064 A * 10/1971 Peterson et al. ..... 340/527
3,757,319 A * 9/1973 Hedin ..... 340/528
4,023,139 A * 5/1977 Samburg ..... 340/506
4,540,980 A * 9/1985 Porco ..... 340/586
5,227,776 A * 7/1993 Starefoss ..... 340/825.36
5,319,698 A * 6/1994 Glidewell et al. ..... 379/39
5,420,567 A 5/1995 Schwarz
5,475,364 A * 12/1995 Kenet ..... 340/522
5,486,810 A * 1/1996 Schwarz ..... 340/521
5,793,286 A 8/1998 Greene
6,078,269 A * 6/2000 Markwell et al. ..... 340/517
6,611,204 B2 * 8/2003 Schmurr ..... 340/538
7,378,976 B1 * 5/2008 Paterno ..... 340/628
2002/0030593 A1 * 3/2002 Leen ..... 340/540
2008/0111706 A1 * 5/2008 Morris ..... 340/692

* cited by examiner

*Primary Examiner* — Travis Hunnings
(74) *Attorney, Agent, or Firm* — Kirk A. Buhler; Buhler & Associates

(57) ABSTRACT

Improvements in a smoke alarm are presented. The multifunction smoke alarm unit includes separate sensors within a single enclosure for detecting smoke and occupancy, sounding a distinctive audible alarm when combustion is detected or the presence of a person within the area of the sensor. The multifunction smoke alarm can replace an existing single function smoke alarm. Multiple multifunction smoke alarms are networkable together for various purposes. Additional features include intruder alarm, visitor annunciator, integrated illumination source, external lighting control, HVAC system control, ceiling fan control, ventilation control, and/or fire safety system control. The proposed multifunction smoke alarm provides much-needed improvements for security, energy saving, safety, and user convenience without the need for completely separate systems for each purpose.

33 Claims, 6 Drawing Sheets

MULTIFUNCTION SMOKE ALARM UNIT

CROSS REFERENCE TO RELATED APPLICATION

This application claims the benefit of Provisional Application 60/931,896 filed May 25, 2007 the entire contents of which are hereby expressly incorporated by reference herein.

FIELD OF THE INVENTION

This invention relates to improvements in a smoke alarm. More particularly, the present smoke alarm is a multifunction smoke alarm unit that sounds an audible alarm when combustion is detected and further incorporates an occupancy sensor. The proposed multifunction smoke alarm provides much-needed improvements for security, energy saving, safety, and user convenience without the need for completely separate systems for each purpose. At the same time, it provides the smoke alarm function required in nearly all buildings and residences.

BACKGROUND OF THE INVENTION

Smoke detection and occupancy detection functions have previously been provided by separate equipment and systems, each designed for its intended purpose. There are different types of single-function smoke alarm units, which detect combustion in one or more ways. Some types detect smoke and/or other products of combustion (such as carbon monoxide). Some types detect fire as a rise in temperature. Various types of single-function smoke alarms (also called fire alarms, heat alarms, etc.) are described in NFPA 72 National Fire Alarm Code. They all function to detect fire in one way or another, using a variety of sensing techniques. NFPA 72 National Fire Alarm code describes various types of smoke and fire alarms and sets industry standards for smoke alarms. The Waft Stopper/Legrand Product Selection Guide 2006/2007 describes various types of occupancy sensors and lighting controls. The "legacy" smoke alarm interconnect has been used to digitally propagate different types of emergency alarms to other units.

A single-function smoke alarm unit contains within its enclosure; smoke detection, and/or gas detection, and/or temperature and/or other fire sensing components, an audible alarm component capable of sounding an emergency evacuation signal, an interconnect component. This allows a smoke alarm unit to be connected to other smoke alarms, visual alarms, and/or external fire alarms, or activate a relay, so that all alarms will sound simultaneously in the event of smoke or fire detection by a single unit within a building. The interconnect requirement is specified by NFPA 72 National Fire Alarm Code. Some types include a light, which illuminates when an alarm is active. Exemplary examples of some single function smoke alarms are identified herein below.

U.S. Pat. Nos. 5,420,567 issued on May 30, 1995 and 5,486,810 issued Jan. 23, 1996 both issued to Frank Schwarz discloses a combination fire/intrusion alarm detectors using active infrared elements. This patent uses a single infrared emitter and detector that detect smoke that breaks the beam of light or the presence of a person that breaks the beam of light. While this patent provides detection and alarm functions for two different events, the sensor is looking for just a beam of light being broken and does not function as an occupancy sensor for the operation of lighting or other house controls such as HVAC.

U.S. Pat. No. 5,793,286 issued Aug. 11, 1998 to Robert Charles Greene discloses a combination infrasonic and infrared intrusion detection system. This system provides detection of intruders and has inputs for other separate devices such as smoke detectors, low temperature detectors and "panic" signals. Each of these inputs is from devices that are separate from the intrusion detection device.

U.S. Pat. No. 6,611,204 issued Aug. 26, 2003 to Randol M. Schmurr discloses a hazard alarm system and communication therefore. The alarm and communication system allows several types of sensors to communicate over a single network without causing a conflict of the data. Each of the sensors is different and is housed in its own housing. The patent more specifically discloses the "network" rather than the sensors. While this patent discloses multiple sensors the sensors are each separate and do not operate with lighting or HVAC components within a business or residence.

What is needed is a multifunction smoke alarm having multiple sensors placed within a single unit that is used to replace a single function smoke alarm. The proposed multifunction smoke alarm unit provides multiple sensors in addition to a sensor for the detection of smoke or fire within a single housing that fits in the same space requirements as a legacy smoke detector. The additional functions provided include occupancy detection, lighting, automatic light control, HVAC control, burglar detection, intruder alarm, audible vacancy alarms and fire alarm controls that have been put into a single replacement unit.

BRIEF SUMMARY OF THE INVENTION

It is an object of the multifunction smoke alarm unit to incorporate a smoke and/or gas detector and/or temperature sensor, an audible alarm, and an interconnect, as is found in single-function smoke alarm. The combustion sensor component can be used for multiple purposes, such as to provide the location of a fire or other status to an external fire safety monitor and/or to control external systems in the event of a fire, by way of the interconnect component(s). The locations can be provided to external systems to aid in the safety and rescue of the occupants of the building. The temperature sensor component used for fire detection, if present, can also be utilized to control HVAC systems, ceiling fans, ventilation fans, or any other device or system which is controlled by temperature, by way of the interconnect component.

It is an object of the multifunction smoke alarm unit to also contain an occupancy sensor component, for detecting the presence or absence of occupants. The occupancy sensor is integrated with the other smoke alarm components, such that greater utilization of all components is achieved. The occupancy sensor is used for multiple purposes, including intrusion warning, visitor annunciation, vacancy determination, control of the light component, control of an external HVAC system, control of external lights, control of ceiling fans, and/or control of other external systems, by way of the interconnect component. The occupancy sensor can operate in various sensitivity modes in order to best perform its current function such as normal sensitivity, for occupancy detection, high sensitivity, for vacancy detection and low sensitivity, for minimizing false intruder alarms. The occupancy sensor provides a wide detection area for occupants within the building. The lights, ceiling fan, etc., in an area or room can be prevented from being turned off unnecessarily, and an energy-saving HVAC system will not enter the setback mode unnecessarily. It provides a means for compliance with the California Title 24 2005 Residential Energy Code's sensor-controlled lighting mandate, without additional dedicated occupancy sensors or connections, when connected to a suitable "manual on/vacancy off" light switch.

It is another object of the multifunction smoke alarm unit to optionally contain a visible light source component to provide additional advantages. It also optionally contains an ambient light sensor to provide additional advantages. The light (lamp) component, if present, can be used for multiple purposes. It can be used to visually signal an alarm. In addition, it can automatically provide lighting when an occupant is present or act as a safety light during an alarm. The visible light (lamp) component used for visible indication of an alarm, if present, for also providing lighting when an area is occupied and/or dark. The ambient light sensor, if present, can keep the light component from coming on when it is not needed for illumination. The light sensor can also provide information to control external lighting devices and systems via the interconnect component. For example, it could be used to turn on a security light for a predetermined time beginning at dusk.

It is still another object of the multifunction smoke alarm unit to connect with one or more interconnect components which can connect to other smoke alarm units and can also connect to a variety of external devices and systems including but not limited to intruder alarm and/or other alarm to other units. It is also used to communicate with various types of external systems and/or with a computer. In the present invention, it has the ability to communicate any type of control and status information needed for the desired functionality. It can be used to configure the settings and operation of a unit, or to download software into the unit. Any combination of these three communication methods can be used including but not limited to hardwired, wireless and power line.

It is still another object of the multifunction smoke alarm unit for it to be used as a substitute for a single-function smoke alarm. It can perform additional functions in addition to the necessary smoke and/or combustion and/or fire alarm function. It can be usefully installed in a building in the same manner and locations as a single-function smoke alarm. Its enclosure can be made to resemble a single-function smoke alarm unit in appearance. It can utilize the industry-standard interconnect wire to interconnect to previous single-function smoke alarms for the purpose of propagating the sounding of the alarm to and from such units. It can utilize the industry-standard interconnect wire to interconnect to other units of the present invention as a general-purpose network communication means, thereby eliminating the need for a separate wire or other communication means between units to perform additional functions. The location of an alarming unit can be electrically communicated over the industry-standard interconnect wire. The interconnect component can be hardwired, wireless, over the power line, or any combination thereof. It can utilize the interconnect component to communicate any type of control and status information for various functions. It can communicate intruder alarms, occupancy status, status of any other sensors within the unit, alarm enable and silence commands, etc., or for any other general control, status, and communication to other units of the present invention and/or to or from various external devices and systems, including computers.

Communication can be directed to a particular unit, and the identity of a reporting unit can be determined. It can route communication messages from any of the hardwired, wireless, or power line interconnects to any of the other interconnect types. It can utilize the interconnect component as a means to initiate an integrity test on all the connected units. The interconnect component can be connected to a computer and used as a means to configure a unit's settings and operation and/or to download software to a unit's microprocessor. It can eliminate the need for separate smoke alarm systems, security systems, and occupancy-based systems of various types. A separate external controller is not required to allow use with external systems or to form a network of units. It can reduce cost, simplify installation, improve reliability, and improve appearance compared to equivalent separate single-function systems. Sensors and controls that can be operated by the multifunction smoke alarm include security systems, HVAC systems, lighting control, ceiling fans, HVAC vents, ventilation fans, motorized window coverings, and/or other systems or devices which are controlled or affected by the presence or absence of an occupant, and/or are controlled or affected by the other sensors within the unit.

It is another object of the multifunction smoke alarm unit for the unit to provide a means to control external lights for security purposes. Using the ambient light sensor, the unit can turn on external lights when the ambient light diminishes to a threshold level, and then turn them off after a predetermined delay, simulating the presence of occupants in an otherwise empty building. When the unit is also used as an intruder alarm, this security light feature can be enabled whenever the intruder alarm is armed and otherwise disabled, thereby providing an extra degree of security. Alternatively, the security light feature can be enabled whenever the room is unoccupied and otherwise disabled.

It is another object of the multifunction smoke alarm unit for the unit to perform self testing when interconnected with other units. The multifunction smoke alarm can initiate an integrity self-test in all units from a single unit, simplifying the procedure. Alternatively, an interconnected external device such as a control unit or computer could be used to initiate the self-test in all units and report the results. It is an industry-standard recommendation to frequently test smoke alarms for correct operation, as often as weekly. Previous smoke alarms generally provide a self-test button on the unit. In a typical home with eight smoke alarms, for example, a weekly test could be impractical, especially if some of the units are attached to a high ceiling.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
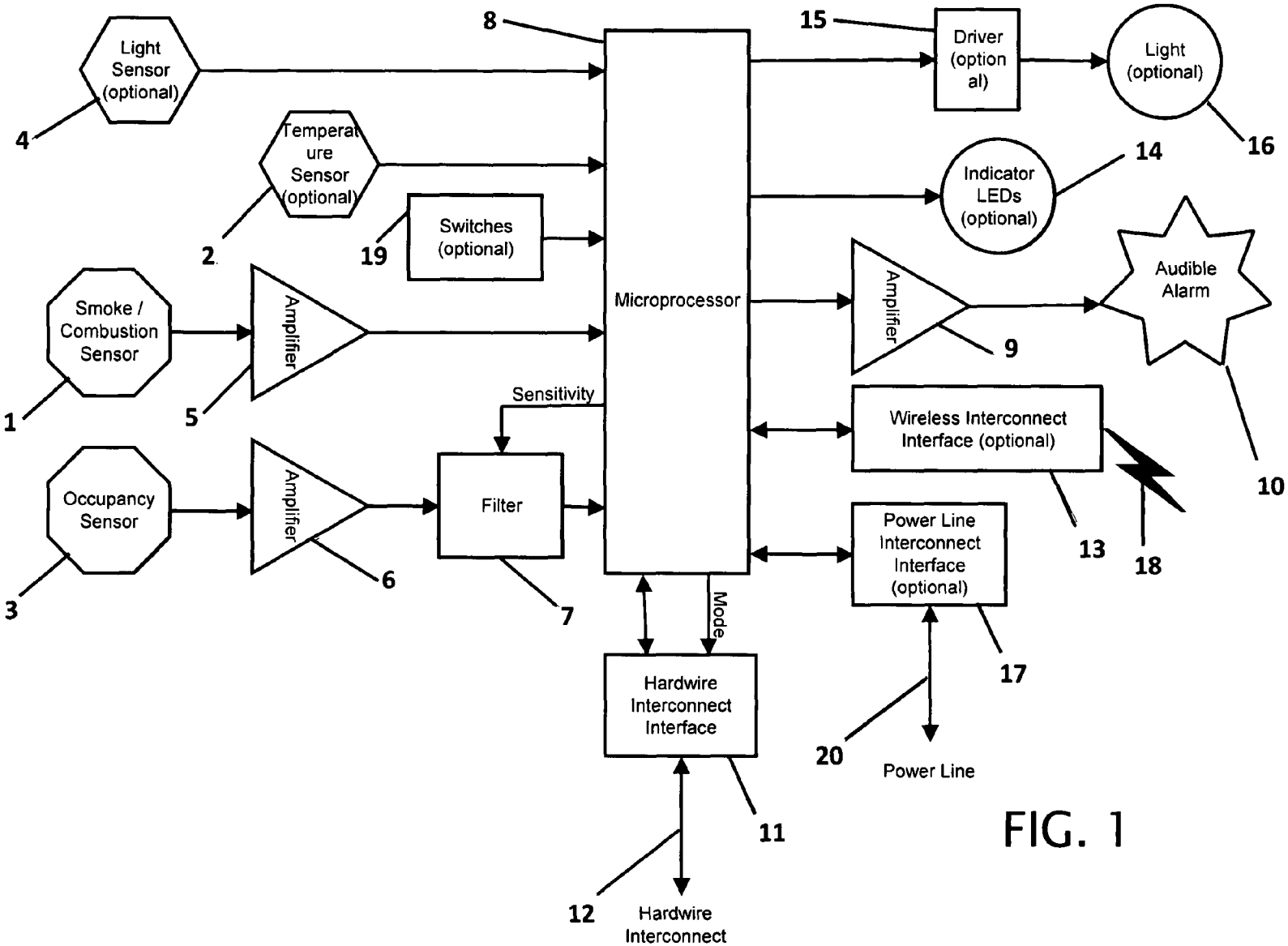
FIG. 1 illustrates a block diagram of a multifunction smoke alarm unit in accordance with the present invention.

FIG. 1 shows a block diagram of a possible implementation of the present invention. The multifunction smoke alarm unit can be embodied in different forms. This exemplifies the principles of the multifunction smoke alarm unit, and is not intended to limit the multifunction smoke alarm unit to the specific embodiment illustrated.

Microprocessor 8 contains a suitable control program and software routines which may be needed to implement the functions described here. There may be different versions of the control program, depending upon the desired functionality. In this embodiment, Microprocessor 8 contains internal volatile and non-volatile memory, I/O ports, and any other hardware needed in order to execute a suitable program. Suitable microprocessor hardware and software techniques are well known and components are widely available.

Smoke sensor 1 detects the presence of an anomaly such as combustion or smoke by one of various methods, such as ionization, particle, or gas detection. Various methods of fire detection are given in NFPA 72 National Fire Alarm code. In this embodiment, amplifier 5 amplifies the analog detection signal and passes it to Microprocessor 8 for further processing. If sufficient combustion is determined to be present by the software in Microprocessor 8, it will activate the audible alarm 10 through amplifier 9. Techniques for smoke, gas, and fire detection are well known and not limited to the method described here. For example, if an ionization type of detector is used, amplifier 5 could be implemented with a smoke detector ASIC such as the Allegro 5368.

Audible alarm 10 is a piezoelectric, magnetic, or other type of audio transducer which can generate a sufficiently loud sound. Microprocessor 8 can modulate the frequency, duration, and amplitude of the audible alarm 10 in order to generate an appropriate and identifiable sound for the type of alarm being sounded. For example, smoke detection might be a pattern of short sounds of a certain frequency, intruder detection might be a continuous sound of dual alternating frequencies, visitor annunciation might be chime-like dual short tones of lower amplitude, a continuous tone might be generated during the security system arming delay period, etc. Voice messages could also be generated by Microprocessor 8. Techniques for generating different alarm sounds and voice messages are well known.

When the alarm is sounded, Microprocessor 8 communicates the alarm electrically to the Hardwire interconnect interface 11. The Hardwire interconnect interface 11 in turn generates the electrical signal needed to communicate the alarm condition to the Hardwire interconnect 12. Hardwire interconnect 12 is a wired connection to other smoke alarms and/or external devices or systems. It can be the industry-standard smoke alarm-interconnect wire, for example. When an alarm condition exists, it propagates the alarm to the other smoke alarms and/or to external systems, if present, such that they also sound their alarms and/or take other appropriate action. Two modes of operation are provided by Hardwire interconnect interface 11.

The first mode of operation is provided by Hardwire interconnect interface 11 for compatibility with previous industry-standard smoke alarms. In this mode, Hardwire interconnect interface 11 and Hardwire interconnect 12 can send an alarm to, or receive an alarm from, previous smoke alarms. This allows the present invention to be connected by wire to previous smoke alarms and previous external alarms for purposes of alarm propagation. The Allegro 5368 ASIC, for example, typifies the use of this "legacy" interconnect. A continuous voltage of about 9 volts is applied to this wire during the alarm to activate connected units; otherwise the wire is left open. For maximum immunity to electrical noise, the receiving units will not sound their alarm unless this signal is held at a steady level for a relatively long time. This method is used to propagate emergency evacuation alarms to previous units and to other units of the present invention.

In the second mode of operation, Hardwire interconnect interface 11 and Hardwire interconnect 12 comprise a two-way digital communication means which is used to send and/or receive a variety of message types to or from other smoke alarms and/or external systems and/or external computers. The messages are generated and/or interpreted by software within Microprocessor 8. Messages and codes and communication protocols are defined such that all the control functions needed for any useful purpose can be performed, and are not limited to alarm propagation. The relatively short and high speed electrical transmission characteristics of these messages are such that any interconnected previous smoke alarms will ignore them and not sound an alarm, because they respond to only to a continuous voltage. Unit addresses are assigned to each unit and used to facilitate communication with other units. Messages can be directed to specific units, and are not limited to broadcasting to all units. Various methods can be used to communicate such messages at an appropriate speed, such as RS232, or any other suitable technique. Suitable hardwire communication techniques are well known.

A wireless communication method is optionally also provided for propagating an alarm and/or other purposes. Wireless interconnect interface 13 is used to communicate wirelessly with external devices and/or computers and/or other smoke alarms, if such devices are present. When Wireless interconnect interface 13 is present, messages equivalent to those sent out on Hardwire interconnect interface 11 are also sent to Wireless interconnect interface 13, which in turn transmits them as radio signals via Antenna 18. Antenna 18 also receives radio signals from other smoke alarms, external devices, and/or computers. Wireless interconnect interface 13 receives these messages and passes them to software running in Microprocessor 8. Unit addresses are assigned to each unit and used to facilitate communication with other units. Various methods can be used to wirelessly communicate the messages, such as IEEE 802.15.4, or any other suitable technique. Suitable wireless communication techniques are well known and components are widely available.

A power line communication method is optionally also provided for propagating an alarm and/or other purposes. Power line interconnect interface 17 is used to communicate via the AC mains power line with external devices and/or computers and/or other smoke alarms, if such devices are present. When Power line interconnect interface 17 is present, messages equivalent to those sent out on Hardwire interconnect interface 11 are also sent to Power line interconnect interface 17, which in turn transmits them via Power line 20. Power line 20 is also used as a means to receive messages from other smoke alarms, external devices, and/or computers. Power line interconnect interface 17 receives these messages and passes them to Microprocessor 8. Unit addresses are assigned to each unit and used to facilitate communication with other units. Various methods can be used for power line communication, such as X10, or any other suitable technique. Suitable power line communication techniques are well known and components are widely available.

It can utilize the dedicated AC power line connection 20, if present, needed for powering the smoke alarm function, also for powering the other functions in the unit. This eliminates the need to install additional power wires for the other functions, such as the occupancy sensor, light, etc. It makes it practical and cost effective to add occupancy detection and/or environmental sensing such as but not limited to temperature or humidity-etc., over all areas of a building without installing additional power wiring.

Microprocessor 8 generates the necessary signals to control the Hardwire interconnect interface 11, Wireless interconnect interface 13, and/or Power line interconnect interface 17. Various methods can be used, including using devices such as UART, SPI, I2C, LAN, WAN, IR or RF etc. controllers, either internally or externally to Microprocessor 8, or using only software. Suitable techniques are well known and components are widely available.

Each of the interconnect types may use a different communication protocol for the transmission and reception of messages, and can use different message formats. The software in Microprocessor 8 can communicate messages to and from each of the interconnect types. The messages can include destination addresses which address other units and external devices. If a unit connects to more than one interconnect type, the software can route messages from one interconnect type to another, depending upon the destination address of the message, the message type, or other method. The message routing can be specified by configuration settings or other means. This allows a message to be passed from a source to a destination over different interconnect types when required by the interconnect topology.

Messages can be sent from an external computer to a unit via any of the interconnect types for purposes of configuring the settings and operation of the unit and/or for downloading software to Microprocessor 8.

The software in Microprocessor 8 thus receives and monitors the hardwired and/or wireless network and/or power line message communications, and performs any appropriate actions and/or responses. For example, if a smoke alarm condition is received from the network, Microprocessor 8 can sound its Audible alarm 10.

Some types of smoke alarms use a temperature sensor to detect a fire condition. In that case, Temperature sensor 2 sends an analog signal to Microprocessor 8. Temperature sensor 2 can be contained within Microprocessor 8 or external to it. If fire is detected by the software running in the Microprocessor 8, it will activate the Audible alarm 10 and communicate the alarm condition to the Hardwire interconnect interface 11 and/or Wireless interconnect interface 13 and/or Power line interconnect interface 17, as described above. It can utilize the temperature sensor 2 component, needed for fire detection purposes, if any, for monitoring and/or controlling temperature via the interconnect to an external device or system. A network of interconnected units can provide temperature readings from many different areas and/or rooms. This can be used to advantage by an external intelligent HVAC controller or thermostat. Building or room ventilation fans, and/or ceiling fans, can be controlled using information from the temperature sensor component.

Occupancy sensor 3 detects the presence of an occupant by one or a combination of various methods, including passive infrared (pyroelectric), ultrasonic, and/or microwave sensing techniques. These techniques detect the motion of an occupant. The diagram shows an embodiment of a passive infrared sensor used for occupancy detection. In this case, a lens is used to focus incoming infrared energy onto the sensor such that motion can be detected. The lens can provide a detection range of up to 360 degrees.

The occupancy sensor information is (occupied or vacancy detection condition) available for multiple purposes. It can be used as a security system, detecting an intruder and sounding an intruder alarm, when armed by an external device. The multifunction smoke alarm has an audio quality announcement capability. No separate controller is required. It can be used to announce a visitor, detecting a visitor and sounding a suitable sound, for example, like a doorbell chime. It can utilize the audible alarm component, needed for smoke and/or fire warning, also for intruder warning and/or visitor annunciation and/or vacancy warning and/or any other useful purpose. Unique, identifiable tone patterns can be generated at different amplitudes, as appropriate, for the type of alarm being sounded. For example, smoke detection might be a pattern of short sounds of a certain frequency, intruder detection might be a continuous sound of dual alternating frequencies, visitor annunciation might be chime-like dual short tones of lower amplitude, a continuous tone might be generated during the security system arming delay period, short chirps might be used for vacancy warning, etc. Voice messages could also be generated for type of alarm.

It can sound an audible vacancy warning prior to determination of a vacant condition. This can alleviate the possible problem that occupants may not be detected if they don't move for a long period of time. If an undetected occupant is present, upon hearing the audible warning, he can move for purposes of being detected. This can prevent incorrect vacancy status from being reported and acted upon by external devices and systems.

In this example, Amplifier 6 amplifies the analog infrared motion detection signals and passes them to Filter 7, which analyzes the motion signals to determine occupancy, reduces false occupancy detection, and provides different levels of sensitivity as needed. If the sensitivity is too high, air currents or other temperature-related phenomena can trigger a false occupancy determination. Sensitivity can be reduced by requiring two or more occupancy detection signals within a predetermined time, for example 15 seconds. In this embodiment, Microprocessor 8 can control Filter 7 such that it provides the desired degree of sensitivity. Sensitivity is reduced when the number of occupancy detection signals needed within a predetermined time interval is increased.

Filter 7 provides an occupancy determination signal to Microprocessor 8 for further processing. Filter 7 can be implemented by a dedicated microprocessor or by using discrete circuitry or both. Filter 7 can alternatively be implemented by software within Microprocessor 8.

If an occupant is detected by the software running in Microprocessor 8, it activates Audible alarm 10, if it is armed for intruder detection, and communicates the occupancy condition to Hardwire interconnect interface 11 and/or Wireless interconnect interface 13 and/or Power line interconnect interface 17, as described above. If no occupant is detected for a period of time, Microprocessor 8 communicates the vacant condition to Hardwire interconnect interface 11 and/or Wireless interconnect interface 13 and/or Power line interconnect interface 17, as described above. Techniques of occupancy detection are well known and not limited to the methods described here, and components are widely available.

Light sensor 4 is optionally added to further increase functionality. Light sensor 4, if present, provides a signal to Microprocessor 8 which indicates the ambient light level. Microprocessor 8 can communicate the light level to an external system via the interconnect(s), as described above. In a similar manner, Microprocessor 8 can communicate the ambient temperature level from Temperature sensor 2, if present, to an external system. Similarly, any other type of sensor (not illustrated here) could be included and connected to Microprocessor 8, and its reading communicated to an external system. Examples of other types of sensors include CO, CO2, H2, humidity, and barometric pressure, audio, optical, or other sensors.

When Occupancy sensor 3 detects the presence of an occupant, as described above, Microprocessor 8 turns on Driver 15, which illuminates Light 16, if present. This action may be additionally conditioned by optional Light Sensor 4. In this case, Light 16 is turned on only when needed, such as when an occupant is present in a dark area or room.

It is well known that air currents or other temperature-related phenomena can cause an occupancy sensor to trigger a false occupied condition. The multifunction smoke alarm unit can advantageously use multiple occupancy sensor sensitivity settings for reliable occupancy detection. At least three sensitivity modes can be used including but not limited to high, medium and low sensitivity.

High sensitivity mode requires only a single detection of motion, whereas lower sensitivity modes require two or more detections of motion within a predetermined time period, for example 15 seconds. False detection of occupancy is therefore minimized when a lower sensitivity mode is selected. When the unit is armed for intruder detection, an even lower sensitivity mode may be selected to minimize false alarms.

Once an occupant is detected, continued detection of an occupant requires the occupant to make a physical motion within a predetermined time period. If the occupant remains motionless for a relatively long time, for example 10 to 30 minutes, vacant (unoccupied) status may be reported by the occupancy sensor. In that case, a vacancy message could be sent to the interconnect which can be used to turn off lights, ceiling fans, etc., or cause the HVAC control to set back to energy-saving mode. This false detection of a vacant condition may be undesirable in some cases. For example, the lights might be turned off even though the room is still occupied. The present invention advantageously incorporates two methods to minimize false vacancy detection.

After an occupant enters a room and is detected in a lower "normal" sensitivity mode, as described above, the occupancy sensor mode is automatically switched to high sensitivity for a period of time. In high sensitivity mode, any single motion detection will extend the occupied state. After a suitable delay of no motion detection, for example 10 to 30 minutes, a vacancy determination is made, and the vacancy message is reported. At that time, the occupancy sensor mode is automatically switched back to a lower sensitivity mode, and remains in that mode until the next determination of occupancy. False detection of vacancy is therefore minimized when the highest sensitivity mode is selected.

The alarm component in the present invention can also be used to prevent undesired reporting of a vacant condition. A short time before the vacant condition is reported, for example 10 seconds, the alarm sounds a distinctive audible vacancy warning. If an occupant is present and hears the warning, he can then provide motion, which is detected by the occupancy sensor, and the vacant condition is not reported. If there is no motion response detected within a short time period, the room is assumed to be unoccupied, and the vacancy status is reported. This vacancy warning and hold off process can be repeated as necessary after successive vacancy detection periods in which no motion is detected. After the user responds to the vacancy warning alarm with a motion, detection of the user's motion by the occupancy sensor can be optionally confirmed by another distinctive sound from the alarm. For example, the vacancy warning sound may consist of a short high-to-low chirp, and confirmation of the user's response can consist of a short low-to-high chirp. Alternatively, voice messages could be used for the same purposes.

The multifunction smoke alarm can be mounted on a ceiling to provide 360 degrees of occupancy detection coverage area, vs. a lesser 180 degrees detection coverage area provided by a wall-mounted occupancy sensor. This can improve upon, for example, an occupancy sensor-based wall-mounted light switch, which can have the possible problem of inadequate occupancy detection coverage. A wider coverage area can be more effective in larger and irregularly shaped rooms and areas.

The multifunction smoke alarm can use multiple occupancy sensor sensitivity settings in order to minimize false occupancy and false vacancy detection. A high sensitivity mode requires only a single detection of motion, whereas lower sensitivity modes require two or more detections of motion within a predetermined time period, for example 15 seconds. False detection of occupancy is minimized when a lower sensitivity mode is selected. False detection of vacancy is minimized when the highest sensitivity mode is selected. Lower sensitivity is normally selected in the vacant condition. When an occupant is detected, high sensitivity mode is automatically selected. When the occupant is no longer detected after a suitable delay, for example 10 to 30 minutes, low sensitivity is again selected.

When it is used as a security system, the sensitivity of the occupancy sensor can be further reduced to a lower than normal level, as described above, when the intruder alarm is armed. This is to minimize false intruder detection alarms. When the unit is not armed, the occupancy detection sensitivity is increased to a normal setting.

When it is used as a security system, vacancy status can be immediately signaled to any controlled devices when the unit becomes armed by the user. This provides a faster detection of no occupancy, which normally is determined only after an absence of occupant motion detection during a predetermined interval of time, for example 10 to 30 minutes.

Light 16 can also be turned on, or flashed on and off, when an alarm is sounded. When a multifunction smoke alarm is used for lighting control, the optional ambient light sensor can be used to determine when the light level in an area is such that a light should be turned on or off. The range of ambient light levels in a 24 hour period can be different for different areas. One problem is that of determining proper ambient light thresholds for lighting control. Light/dark threshold levels can be preassigned to a unit, or an adaptive determination can be made.

The maximum and minimum ambient light level readings can be stored by the microprocessor within each unit, and updated at frequent intervals. This will allow the long-term range of ambient light levels to be known. Then a dark/light determination can be made by comparing the current ambient light level to threshold levels near the minimum and maximum levels. This technique makes each unit adaptive to its particular environment, and may provide more accurate lighting control than predetermined thresholds. Seasonal ambient light variation differences could be adjusted for by periodically replacing the minimum and maximum values with recently determined values.

The ambient light sensor provides a means to control external lights for security purposes. If a unit is connected to an external light controller, the unit can turn on external lights when the ambient light diminishes to a low threshold level, as described above. The unit can then turn the lights off after a predetermined delay, simulating the presence of occupants in an otherwise empty building. The security light feature can be enabled whenever the room is unoccupied for a lengthy time, for example one hour, and is otherwise disabled. Thus the security light 16 operates only when the area is vacant, and does not have to be enabled or disabled by the user. When the unit is also used as an intruder alarm, the security light feature can be enabled automatically whenever the intruder alarm is armed, and otherwise disabled, thereby providing an extra degree of intruder security, and also eliminating a separate step to enable the security light.

Switches 19, if present, can be used to configure the operation of the unit. Software in Microprocessor 8 can read the switches to provide the desired functions and to behave in any of various ways. For example, switches can be used to define the communication address of the unit. A switch can be used to enter an "association" mode, such that external devices can be linked to the unit. Alternatively, switches can define the address of an external device to be controlled. Features can be enabled or disabled with switches. A switch may be used to turn off an active alarm, test the unit, etc. Some switches may be accessible from the exterior of the unit.

Indicator LEDs 14 provide a visual status display. They are controlled by Microprocessor 8 to indicate status such as power on, unit operational integrity, alarm active, etc.

Power to the unit can be provided by any suitable means internal or external to the unit, such as the AC power mains, low voltage wiring, DC wiring, or a primary battery. A backup power source is specified by industry standards.

Other customary and/or industry standard functions may be implemented within the unit that are not detailed here, such as monitoring battery voltage, detecting power failure, etc. Such techniques are well known.

Microprocessor 8 can have a variety of input and output signal types, depending upon the implementation details of the present invention. Analog inputs and internal A/D converters can be used to measure analog signals from analog sensors, digital inputs can be used to receive signals from digital sensors, a D/A converter and analog output can be used to drive the audible alarm, digital outputs can be used for control and communication, etc. As is well known, the details of implementation can vary to produce the equivalent results of the embodiment presented here. For example, Microprocessor 8 and/or any or all of the electronics could be replaced with a gate array chip or ASIC, or Microprocessor 8 and Wireless interconnect interface 13 could be replaced with a single system-on-a-chip device, etc. In other embodiments, hardware could be used to replace software functionality, and/or software could be used to replace hardware functionality. Separate control circuits could be used for each sensor, sharing only the interconnect(s). An external oscillator could be used to drive the audible alarm, etc.

The unit's enclosure includes an opening such that air can flow to the smoke detection chamber, which contains Smoke sensor 1. In addition, it contains an opening such that Occupancy sensor 3 can properly function. If the occupancy sensor consists of a passive infrared sensor and uses a lens to focus the infrared radiation on the sensor, for example, an opening is provided such that infrared radiation can reach the lens. In this case, the enclosure prevents air flow from reaching the infrared sensor in order to minimize the possibility of air currents falsely triggering occupancy detection. The lens could be optionally concealed, thereby making the unit appear similar to a single-function smoke alarm, by covering it with a flat material, such as plastic, which has the property that it passes infrared light but not visible light. The enclosure also has openings as needed for the audio alarm, light, light sensor, etc.

Figure 2:
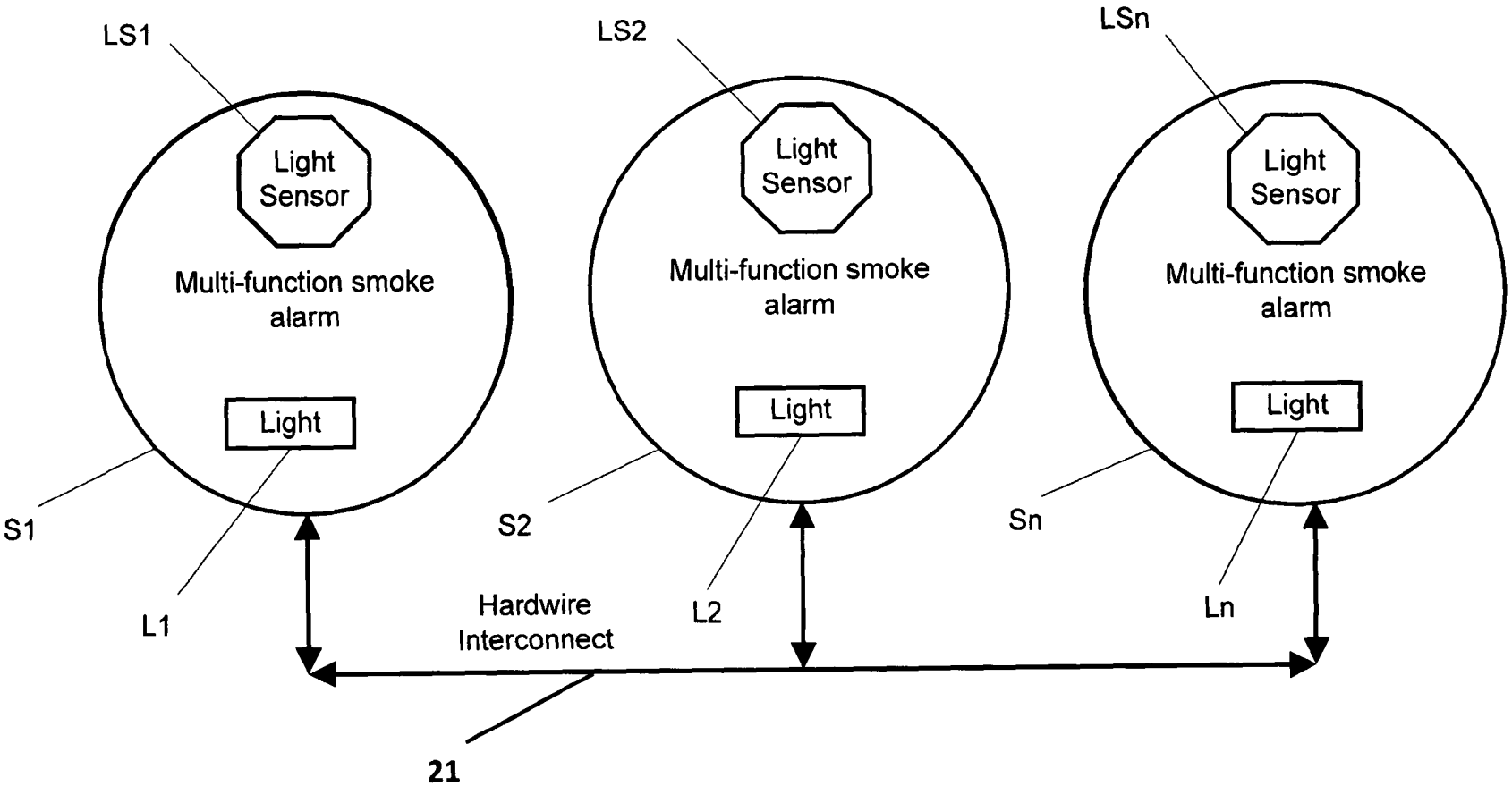
FIG. 2 illustrates a possible use of a multifunction smoke alarm unit as a smoke alarm and an automatic night-light.

FIG. 2 shows a diagram of a possible combination night-light and smoke alarm which utilizes the present invention to advantage. This example uses one or more Multifunction smoke alarms S1 to Sn as smoke alarms and also as automatic night-lights. In this example, no external devices are connected. Multifunction smoke alarms S1 to Sn each contain a light L1 to Ln, a light sensor LS1 to LSn, and a temperature sensor. They operate as smoke alarms and are connected by Hardwire interconnect 21 for the purpose of smoke alarm propagation, as described above.

When an occupant is detected by any of the Multifunction smoke alarms S1 to Sn, if its Light sensor LS1 to LSn detects darkness, its light L1 to Ln is turned on. Its light L1 to Ln remains on until no occupant is detected for a predetermined period of time, and then it is turned off. Thus automatic lighting is provided only when needed.

A temperature sensor in each of the of the Multifunction smoke alarms S1 to Sn monitors the temperature rise when its light L1 to Ln is on. If there is excessive temperature rise, the light is turned off. This optional feature makes it possible to use a relatively powerful light for at least a short time.

Figure 3:
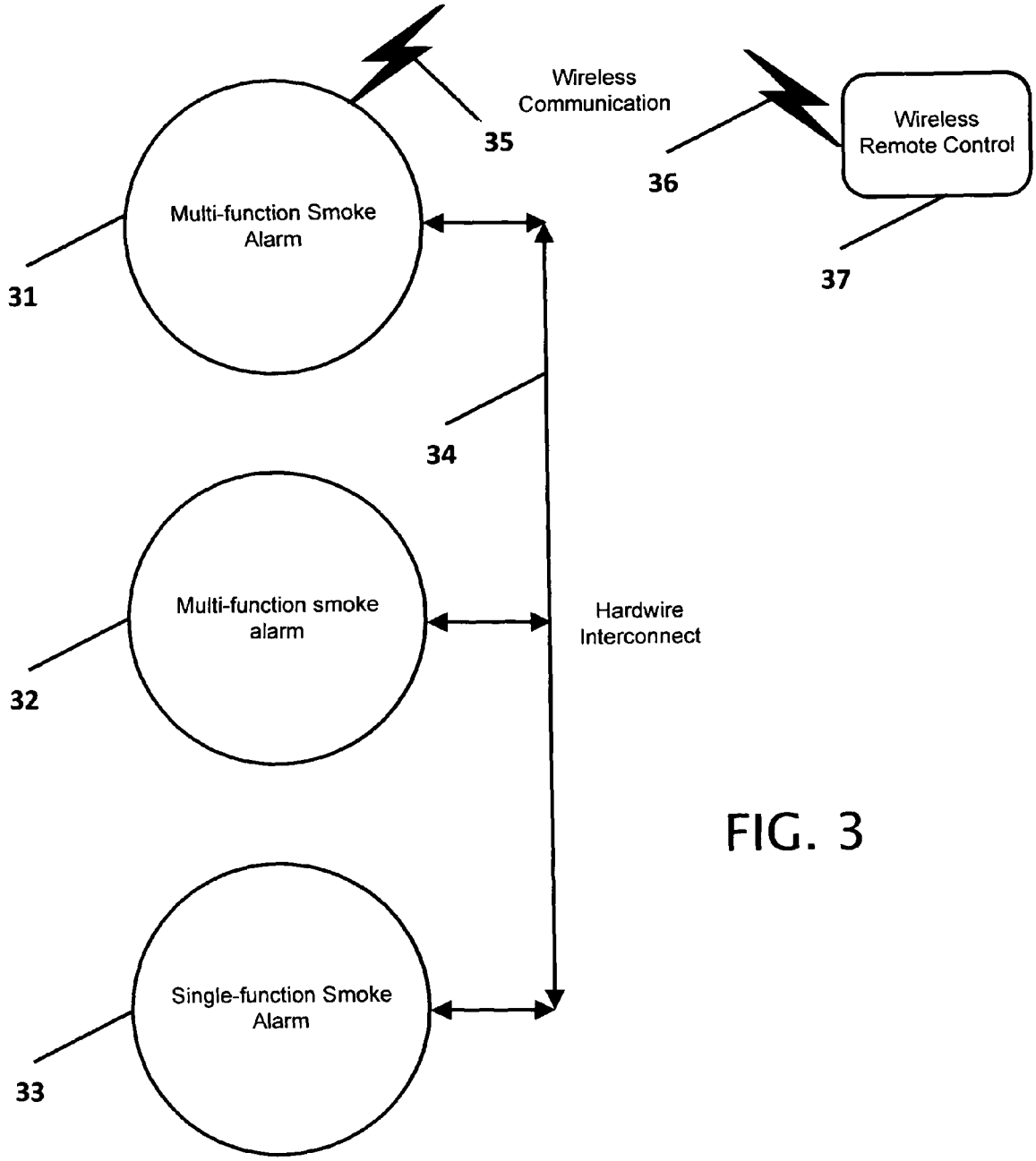
FIG. 3 illustrates a possible use of a multifunction smoke alarm unit as a smoke and security alarm.

FIG. 3 shows a diagram of a possible combination security alarm and smoke alarm system which utilizes the present invention to advantage. Many useful configurations of systems using the multifunction smoke alarm unit are possible. One or more multifunction smoke alarms and zero or more external devices and/or systems and/or previous single-function smoke alarms can be incorporated into a system.

This example illustrates how the hardwire and optional wireless interconnect methods can be used in conjunction with units of the present invention and with previous units.

This example uses Multifunction smoke alarms 31 and 32 as both smoke alarms and intruder alarms. Multifunction smoke alarm 31 includes a wireless interconnect. Wireless Remote Control 37 is used to arm or disarm the intruder alarm via Wireless interconnect antenna 36 and Wireless interconnect antenna 35. Once armed, if the occupancy sensor in Multifunction smoke alarms 31 or 32 detects an intruder, it then generates a uniquely identifiable audible intruder alarm. If smoke is detected by Multifunction smoke alarms 31 or 32, a uniquely identifiable emergency evacuation smoke alarm is generated.

In this example, Multifunction smoke alarms 31 and 32 and Single-function smoke alarm 33 are connected via Hardwire interconnect 34. This illustrates the possibility of expansion to multiple units of the present invention and of previous units. It also illustrates how both the hardwire interconnect and the wireless interconnect can be used together. Multifunction smoke alarm 32 and Single-function smoke alarm 33 will also sound their smoke alarm when a smoke alarm signal is received from Multifunction smoke alarm 31. Multifunction smoke alarm 32 will also sound an intruder alarm when an intruder alarm is received from Multifunction smoke alarm 31. Single-function smoke alarm 33 can only sound a smoke alarm.

Multifunction smoke alarm 31 can receive arm and disarm commands from Wireless Remote Control 37. The intruder alarm arm and disarm commands are routed by Multifunction smoke alarm 31 to Multifunction smoke alarm 32 via Hardwire interconnect 34.

When armed as described above, if Multifunction smoke alarm 32 detects an intruder or detects smoke, it sounds its alarm in the appropriate way and propagates the alarm to the other connected units, as described above.

When Single-function smoke alarm 33 detects smoke, it sends a signal to Multifunction smoke alarm 31 and Multifunction smoke alarm 32 via Hardwire interconnect 34, thus causing all smoke alarms to sound.

Wireless Remote Control 37 is used to turn off active alarms via Wireless interconnect antenna 6 and Wireless interconnect antenna 35. Multifunction smoke alarm 31 receives and routes the command to the other units via Hardwire interconnect 34.

Figure 4:
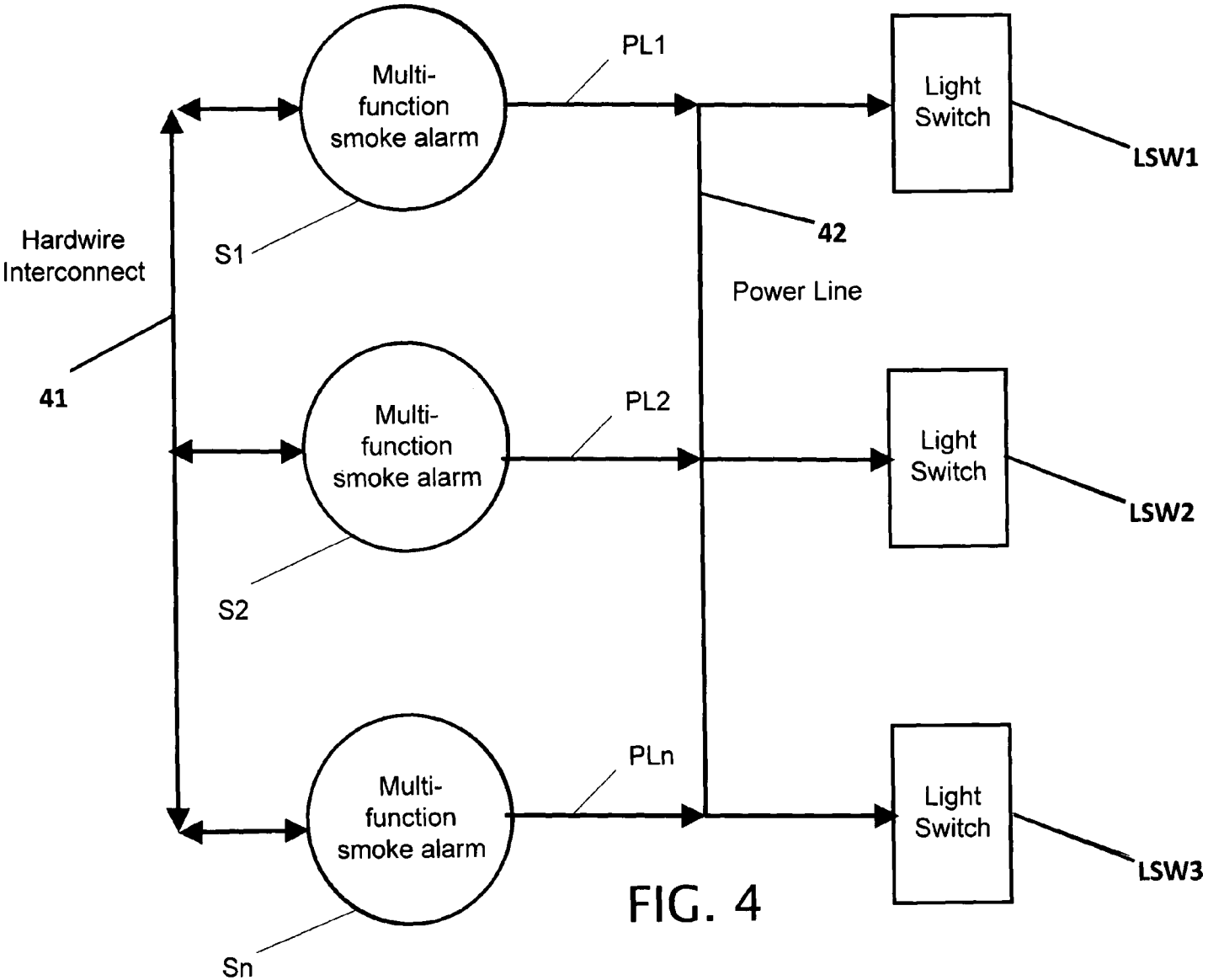
FIG. 4 illustrates a possible use of a multifunction smoke alarm unit in a system with power line interconnects.

FIG. 4 shows a diagram of another possible system which utilizes the present invention to advantage. This example illustrates how a multifunction smoke alarm can be used both as a smoke alarm and also as a means comply with the California Title 24 Residential Energy Code, which mandates that lighting must be controlled with an occupancy sensor in some cases. The present invention can be used to comply with this code when used with suitable light switches. Such a light switch is turned on manually by the user. It is turned off automatically when a "vacancy" signal is received from the multifunction smoke alarm, indicating no occupants are detected in a particular area or room. An example of such a light switch is the X10.com WS467 Wall Switch Module, which is controlled via the power line.

This example illustrates how the hardwire and optional power line interconnect methods can be used. The arrows indicate the directions of communication flow in this example.

Smoke alarms can be powered from the AC power mains and/or from batteries. It is now an industry standard to add dedicated AC commercial power wiring to new building construction for the sole purpose of providing power to smoke alarms, as specified in NFPA 72 National Fire Alarm Code. The present Multifunction smoke alarm utilizes the power line connection provided for the smoke alarm, if present, also for powering its other functions. This eliminates the need to install additional power wires for the other functions, such as the occupancy sensor, light, etc. This makes it practical and cost-effective, for example, to use a multifunction smoke detector as an automatic night-light, as described below. It may be impractical or cost-prohibitive to install additional power wiring to separate specialized units to perform the equivalent functions which can otherwise be performed by the present invention. For example, whole-house occupancy-based energy-saving HVAC control requires the installation of multiple specialized occupancy sensors throughout the house. The present invention eliminates this need, and the need for additional power wiring.

In this example, each Multifunction smoke alarm S1 to Sn has been "linked" for control purposes to a Light switch LSW1 to LSWn, each of which is in the same area or room as the corresponding Multifunction smoke alarm S1 to Sn. Linking is accomplished by setting the unit address of the Light switch LSW1 to LSWn into its controlling Multifunction smoke alarm S1 to Sn, using switches or another technique. Such methods are well known.

Multifunction smoke alarms S1 to Sn detect any smoke or occupants within their detection area or room. If smoke is detected, the detecting unit sounds its smoke alarm, and propagates the alarm to the other units via Hardware interconnect 41. If a vacant condition is detected (i.e. no occupant motion for a predetermined period of time), Multifunction smoke alarm S1 to Sn sends a command to turn its linked switch off via Power line interface PL1 to PLn to the Power line 42. The Light switch LSW1 to LSWn which was previously linked with the commanding Multifunction smoke alarm S1 to Sn will receive the command and turn its light off. Thus each of the Multifunction smoke alarms S1 to Sn separately and independently can turn off its linked Light switch LSW1 to LSWn.

Before a command is sent to turn a light off, a vacancy warning can be sounded, if enabled. This alerts any undetected occupant in the area to provide motion so that he will be detected by the Multifunction smoke alarm S1 to Sn which sounded the vacancy warning. Detection of this motion by the occupancy sensor will prevent the light off command from being sent until the vacant condition is again detected after the next predetermined time interval.

In a variation of this example (not shown), only a single Power line interface PL1 is used to send vacancy information to Power line 42, and Power line interface PL2 to PLn are not needed. In this case, Hardware interconnect 41 is used to convey vacancy status from Multifunction smoke alarms S2 to Sn to Multifunction smoke alarm S1, which in turn routes it to Power line 42.

In another variation of this example, each of the Multifunction smoke alarms S1 to Sn separately and independently can turn its linked Light switch LSW1 to LSWn either on or off, depending upon the occupancy status of the area, thereby providing fully automatic lighting. Such operation could be inhibited by the ambient light sensor in the unit (not shown) when adequate ambient light is already present, in order to conserve energy.

In another variation of this example, the Multifunction smoke alarms S1 to Sn can turn linked Light switches LSW1 to LSWn on when the ambient light of an unoccupied room drops to a low level, as determined by the ambient light sensor in each unit (not shown), thereby providing a security light function. By turning the lights on at dusk, for example, and turning them off again after a predetermined delay, a vacant building can be made to appear occupied. This feature is automatically disabled when a room is occupied, because the occupant may have changed the ambient light level.

Figure 5:
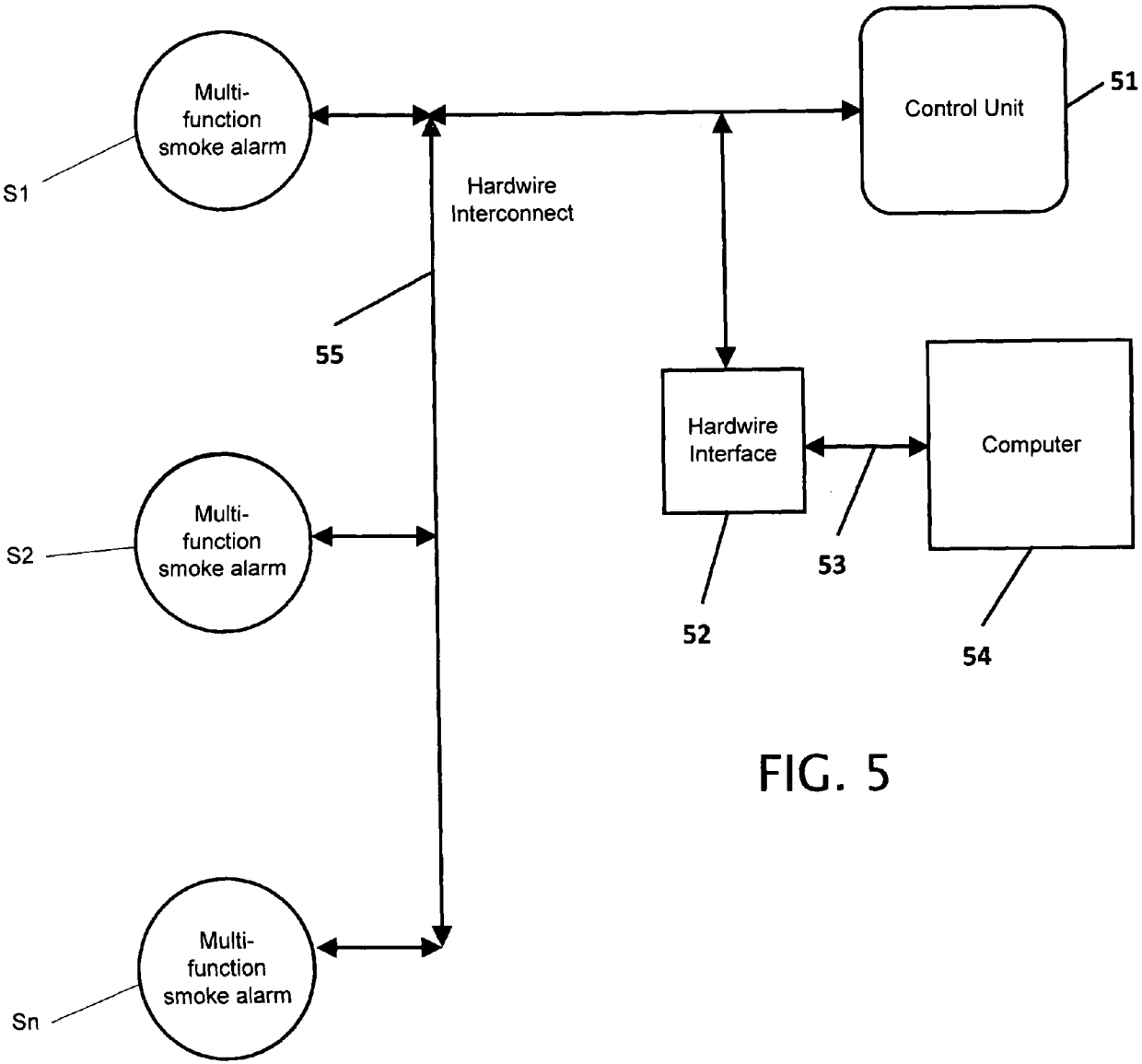
FIG. 5 illustrates a possible use of a multifunction smoke alarm unit in a system with hardwired interconnects.

FIG. 5 shows a diagram of another possible system which utilizes the present Multifunction smoke alarm to its advantage. This example illustrates how a hardwired interconnect can be used to link one or more Multifunction smoke alarms S1 to Sn, an external Control unit 51, and a Computer 54. This example exemplifies the principles and possible uses of the multifunction smoke alarm unit, and is not intended to limit usage to the specific configuration illustrated. More or fewer smoke alarms can be used, and a variety of external devices and systems can be connected, as explained previously.

The interconnect has been an industry-standard requirement for smoke alarms in new residential construction since 1993. It is used to propagate the alarm from a single alarm to all interconnected alarms. In some cases, warning lights, relays, etc. are attached to the interconnect to further propagate the alarm.

The industry-standard interconnect is in the form of a dedicated wire which is connected to all the smoke alarms in a building. An alarm is signaled to the interconnect by means of a voltage which is present while the alarm is sounding. Smoke detector ASICs, similar to the Allegro 5368, have been used in smoke detectors for over 25 years. They operate by applying a voltage of about 9 volts to the interconnect wire when an alarm is sounded, and otherwise disconnect from the wire. This industry-standard interconnect technique does not electrically communicate the location of the unit sounding an alarm.

There have been some previous enhancements to this "legacy" interconnect. Such schemes have been limited to propagating different types of alarms over one wire, such as both smoke and carbon monoxide.

The present invention utilizes this interconnect, if present, to propagate an alarm in the same manner as previous industry-standard units. It can also use the same interconnect as a general purpose communications means for any useful purpose, as described below. This can eliminate the need to install additional dedicated wires for communication. The industry-standard smoke alarm interconnect can thus be utilized by the present invention to form a whole-house network of multifunction smoke alarms, without the expense and difficulty of adding additional wiring. External devices and systems can be advantageously connected, as described below. In addition, the location of the unit sounding an alarm can be electrically communicated to an external device.

One or more Multifunction smoke alarms S1 to Sn are installed in the rooms and/or areas to be monitored for smoke and/or fire and/or occupancy. They use Hardwire interconnect 5 to communicate with each other and with any external devices and/or systems which may be connected. For example, if a Multifunction smoke alarm S1 to Sn detects smoke, fire, or an intruder, it will sound its alarm and also communicate the alarm condition to Hardwire interconnect 55. The other Multifunction smoke alarms S1 to Sn will receive the communication and also sound their alarms.

In this example, Control unit 51 provides the user with a means to silence the smoke alarm, arm and disarm the intruder alarm, silence the intruder alarm, monitor smoke alarm and intruder alarm status, identify which alarms are sounding, and otherwise control the behavior of the system to accomplish the desired functions. It communicates with the other units using Hardwire interconnect 55. Other customized control units can be created to perform any purposes desired, so long as they can, in this case, communicate via Hardwire interconnect 55.

Computer 54 provides the user with a flexible capability to monitor and control the system with a variety of programs. It can perform many functions, such as displaying the location of an alarm, sending configuration settings to the units, data logging and analysis, providing a gateway to another network or to the Internet, and other functions limited only by the application software used. Computer connection 53 connects the computer's I/O connection, such as a USB or serial port, to Hardwire Interface 52. Hardwire Interface 52 converts Hardwire interconnect 55 signals to a form suitable for Computer connection 53. When connected to a computer, the interconnect can be used as a means to configure the settings and operation of the unit and/or to download software to the unit's microprocessor.

The interconnect component of the present invention allows one or more external devices or systems to be usefully attached, either by wired or wireless means, or through the power line, or any combination thereof. Data from the sensors within one or more interconnected multifunction smoke alarm units can be used for a variety of purposes by external devices and systems. In addition, external devices and systems can control the behavior and operation of the multifunction smoke alarm units. A single unit, or multiple interconnected units, can be used in conjunction with one or more external devices and systems.

Some examples of use with external devices and systems are described here to illustrate the utility of this invention. This exemplifies the possible uses, and is not intended to limit it to the specific uses described. Many more uses are made possible by its multifunction capabilities, interconnect components, and communication capabilities.

Figure 6:
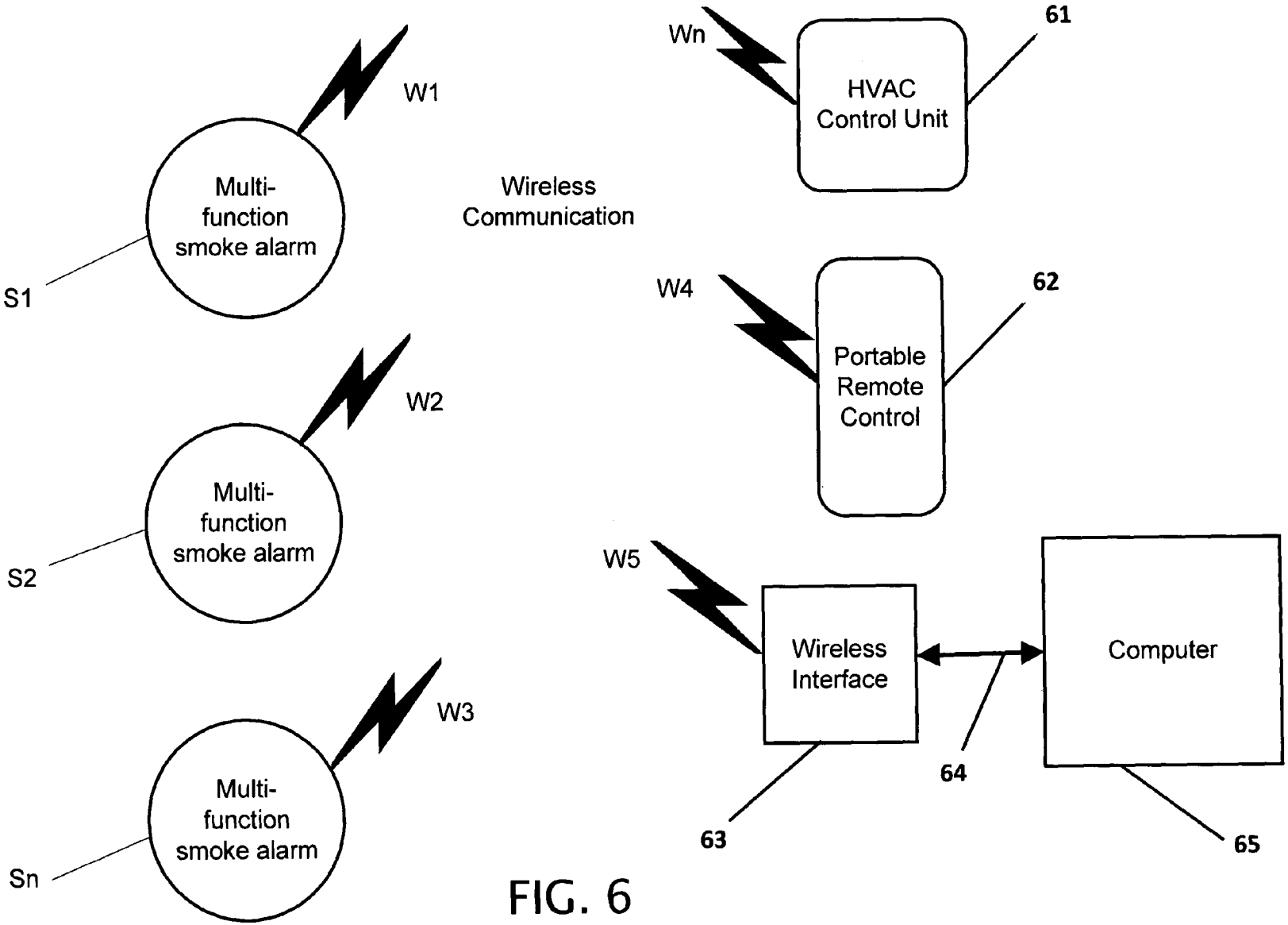
FIG. 6 illustrates a possible use of a multifunction smoke alarm unit in a system with wireless interconnects.

FIG. 6 shows a diagram of another possible system which utilizes the present invention to advantage. This example illustrates how the optional wireless interconnect can be used to link one or more Multifunction smoke alarms S1 to Sn, an HVAC control unit 61, a Portable Remote Control 62, and Computer 65. This example exemplifies the principles and possible uses of the multifunction smoke alarm unit, and is not intended to limit usage to the specific configuration illustrated. More or fewer smoke alarms can be used, and a variety of external devices and systems can be connected, as explained previously.

External remote controls can be used to arm and disarm the intruder alarm, silence a nuisance smoke alarm, silence an intruder alarm, etc. Examples are wireless keychain remote controls, wired, wireless, or power line control boxes, etc.

Energy-saving lighting has been mandated by the California Title 24 2005 Residential Energy Code. The present invention can be used to comply with this code when used with a suitable light switch. Such a light switch is turned on manually by the user. It is turned off when a "vacancy" communication is received from the present invention, indicating no occupants are detected.

Previous energy-saving light switches contain a built-in occupancy sensor. When mounted on a wall, their detection area is limited to 180 degrees. In some cases, this could result in an inadequate detection area. The present invention can be mounted on a ceiling, thereby providing a greater 360 degree detection area.

Energy-saving setback thermostats have been designed to reduce HVAC use when an area or room is determined to be vacant by an occupancy sensor. These have been typically used for small areas, such as hotel rooms, school classrooms, and the like. Such systems are not widely used for large areas and multiple rooms, because of the difficulty and expense of installing the occupancy sensors, power lines, and network connections needed for such a system. The present invention can provide the necessary occupancy information for an entire building to an external HVAC control system, thereby enabling use of a multi-room energy-saving HVAC control without additional separate occupancy sensors or connections. Thus the multifunction smoke alarm enables whole-house or whole-building energy-saving HVAC control simply and inexpensively.

By virtue of its multiple capabilities, the present invention can also be used to enable an external fire safety system. In the event of a fire, the location of the fire can be communicated to an external system, and also whether the building is empty, and also the locations of those remaining within the burning building, and also communicate with the HVAC system and/or ventilation fans during a fire in order to minimize smoke distribution, and also communicate with a lighting system in order to turn on the lights during a fire, etc. External room lighting controllers can utilize the occupancy and ambient light sensor information for energy-saving and automatic operation. In the case of smoke or fire detection and alarming, the present invention can also signal the location of occupants by sounding a distinctive smoke alarm in the locations in which occupancy is detected. This can possibly save lives by alerting rescue workers, especially if there are many rooms to search.

Timers are often used to turn security lights on and off to simulate the presence of occupants. The present invention can be used to turn security lights in an unoccupied room on at dusk, for example, and then turn them off after a predetermined delay. When this feature is used in conjunction with the intruder alarm feature, the automatic security light operation could be enabled when the unit was armed to report intruders, and otherwise be disabled. Controllers for ceiling fans, HVAC vents, etc. can be connected to provide energy-saving and automatic operation. They can utilize the occupancy and temperature sensors.

A network of interconnected units can provide temperature readings from many different areas and/or rooms. This can be utilized to advantage by a connected external intelligent HVAC controller or thermostat. It can also be utilized to control building ventilation fans.

An external computer can be connected for various uses, limited only by the software application. It can be used for configuring the operational behavior of the connected units, monitoring, data logging, connection of the interconnected units to wireless networks and/or to the Internet, etc.

Multifunction smoke alarm units thus provide a flexible and expandable platform not provided by previous smoke alarm units. One or more multifunction smoke alarm units can be installed in a building in a similar fashion as previous single-function smoke alarms to meet smoke alarm needs only, for example, and then additional capabilities and external systems, such as those mentioned above, can be interconnected at any time.

One or more Multifunction smoke alarms S1 to Sn are installed in the rooms and/or areas to be monitored for smoke and/or fire and/or occupancy. They use Wireless interconnect W1 to Wn to communicate with each other and with the external devices and systems. For example, as in the hardwired system previously described, if a Multifunction smoke alarm S1 to Sn detects smoke, fire, or an intruder, it will sound its alarm and also communicate the alarm condition to Wireless interconnect W1 to Wn. The other Multifunction smoke alarms S1 to Sn will receive the communication and also sound their alarms.

Portable remote control 62 provides the user with a convenient means to silence the smoke alarm, arm and disarm the intruder alarm, silence the intruder alarm, and otherwise control the behavior of the system to accomplish the desired functions. It communicates with the other units using Wireless interconnect W1 to Wn. It could be a handheld or keychain remote, for example, providing a convenient portable means for controlling the system.

Computer 65 provides the user with a flexible capability to monitor and control the system with a variety of programs. It can perform many functions, as previously explained. Computer connection 64 connects the computer's I/O connection, such as a USB or serial port, to Wireless interface 63. Wireless interface 63 converts Hardwire Wireless interconnect W1 to Wn signals to a form suitable for Computer connection 64.

HVAC control unit 61 utilizes the occupancy information from Multifunction smoke alarms S1 to Sn to perform energy saving HVAC control. For example, HVAC control unit 61 might be in the form of a setback thermostat. Multifunction smoke alarms S1 to Sn communicate vacancy status to HVAC control unit 61 via Wireless interconnect W1 to Wn. When the building becomes vacant, the thermostat can reduce HVAC usage. When the building once more becomes occupied, HVAC can be returned to normal control.

Installation

NFPA 72 National Fire Alarm code specifies industry-standard locations for installing smoke alarms, which allow them to best protect all the living areas of a home or occupied areas of a building from smoke and fire. The best locations for smoke alarm installation are usually locations well-suited for occupancy sensor installation because a wide detection area for occupants within the building results, and because smoke detectors are generally not installed in areas which are conducive to false or poor occupancy detection, such as near forced air heating ducts, and because smoke alarms are most often installed on ceilings. This can result in a wider coverage area for occupancy detection than that of wall-mounted occupancy sensors.

The present multifunction smoke alarm inherently utilizes this previously unutilized property of mutually beneficial locations to considerable advantage. By following the standards for smoke alarm installation, good results will generally also be achieved for occupancy, vacancy, and intruder detection.

Upon installation a multifunction smoke alarm may require a custom configuration, including but not limited to, enabling and disabling the desired set of features, operational behavior, alarm settings, establishing communication and linking with external devices, defining the interconnect type for communication, defining a unit address for communications.

Testing

It is an industry-standard recommendation to frequently test smoke alarms for correct operation, as often as weekly. Previous smoke alarms generally provide a self-test button on the unit. In a typical home with eight smoke alarms, for example, a weekly test could be impractical, especially if some of the units are attached to a high ceiling. The present invention, when interconnected with other units, can initiate integrity self-test in all units from a single unit, simplifying the procedure. Alternatively, an interconnected external device such as a control unit or computer could be used to initiate the self-test in all units and report the results.

Various embodiments of the present invention are possible. Operation and optional feature selection can be customized by various methods, including different versions or designs of electronic boards, installation or removal of components designated as optional within the unit, use of daughterboard modules which optionally plug into the unit, different versions of software for the unit's microprocessor. Software could be pre-loaded into the microprocessor, and/or downloaded from a computer via the unit's interconnect, switches and/or jumpers within the unit and information from an external source, such as a computer. The configuration information can be transferred from a computer to the unit via the unit's interconnect, and stored in non-volatile memory within the unit.

Thus, specific embodiments of a multifunction smoke alarm unit have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A multifunction smoke alarm unit comprising:

a single enclosure that approximates the size of a smoke detector configured for installation on a ceiling or wall;

at least two separate sensors located within said single enclosure, wherein at least one of said sensors is a smoke or combustion detector, and at least one of said sensors is an occupancy sensor that detects the presence and absence of occupants;

said at least two separate sensors are powered externally from an AC source;

said at least two separate sensors further includes a battery to provide power in the event of AC power disruption;

further includes at least one hard wired interconnect which can connect to at least one other smoke alarm or multifunction smoke alarm unit;

said interconnect link(s) provides propagation of smoke alarms, occupancy alarms and signal events to at least a second smoke alarm and or multifunction smoke alarm, and at least one audible warning device for notification of a-combustion or an occupancy or vacancy detection event.

2. The multifunction smoke alarm unit according to claim 1 that further includes one or more communication link(s) which can connect to at least one network, computer network, external lighting, HVAC system, HVAC thermostat ceiling fan, ventilation system, security alarm, and or fire safety system.

3. The multifunction smoke alarm unit according to claim 1 that further includes an ambient light sensor that determines the light level in proximity to said multifunctional smoke alarm unit.

4. The multifunction smoke alarm unit according to claim 1 that further includes an integrated illumination source.

5. The multifunction smoke alarm unit according to claim 2 wherein said communications link(s) is/are, wireless, or power line communication.

6. The multifunction smoke alarm unit according to claim 5 wherein said communications link(s) provides control information for external lighting, HVAC systems, HVAC thermostats, ceiling fans, ventilation systems, security alarms, fire safety systems that utilize the sensor information from at least one other smoke alarm or multifunction smoke alarm.

7. The multifunction smoke alarm unit according to claim 1 which functions both as a smoke alarm and as an intruder detection security alarm.

8. The multifunction smoke alarm unit according to claim 1 which functions both as a smoke alarm and as a visitor annunciation device.

9. The multifunction smoke alarm unit according to claim 4 which functions as a smoke alarm and also provides lighting activation of said integrated illumination source when an occupant is present and or when sufficient ambient light is not present.

10. The multifunction smoke alarm unit according to claim 6 which functions as a smoke alarm and also turns on and or off external lighting automatically based upon the presence or absence of at least one occupant and or as a function of the ambient light level.

11. The multifunction smoke alarm unit according to claim 6 which functions as a smoke alarm and also adjusts the HVAC system temperature setback automatically as a function of the presence of at least one occupant or absence of all occupants.

12. The multifunction smoke alarm unit according to claim 1 that is compatible with and connects to NFPA 72 National Fire Alarm code industry standard for smoke alarm AC power wires and or interconnect wires.

13. The multifunction smoke alarm unit according to claim 5 wherein said communications link(s) is/are used by at least one external remote control device(s) to control the operation and/or alarm functions and/or initiate self-testing of at least one multifunction smoke alarm unit.

14. The multifunction smoke alarm unit according to claim 5 wherein said communications link(s) is/are used by an external computer for control, upload new operating software, download stored data, monitoring, and or testing, by a software application in conjunction with at least one multifunction smoke alarm unit.

15. The multifunction smoke alarm unit according to claim 1 that further incorporates automatic selection of multiple occupancy sensitivity settings to reduce a probability of false occupancy or false vacancy detection.

16. The multifunction smoke alarm unit according to claim 1 that further sounds an audible "vacancy warning" alarm to inform an at least one stationary occupant to move in order to avert false detection of vacancy.

17. The multifunction smoke alarm unit according to claim 9 which functions as a smoke alarm and also turns on and or off external lighting automatically based upon the presence or absence of at least one occupant and or as a function of the ambient light level and wherein light and dark detection thresholds are adaptively determined for lighting control.

18. The multifunction smoke alarm unit according to claim 1 that further has a concealed occupancy sensor lens.

19. The multifunction smoke alarm unit according to claim 1 that incorporates an interior sealed chamber containing the occupancy sensor element, which prevents air flow from entering and falsely triggering the occupancy sensor, and also an open chamber for enclosing the combustion sensing element, which allows smoke to enter the open chamber.

20. The multifunction smoke alarm unit according to claim 2 wherein said communications link(s) provides control information for external lighting, HVAC systems, ceiling fans, ventilation systems, security alarms, fire safety systems.

21. The multifunction smoke alarm unit according to claim 18 wherein the outward appearance of said multifunction smoke alarm does not have the appearance of a motion sensor.

22. The multifunction smoke alarm unit according to claim 12 which utilizes said NFPA 72 National Fire Alarm code industry standard smoke alarm AC wiring to control at least one of external lighting, HVAC systems, ceiling fans, ventilation systems, security alarms, fire safety systems by means of power line communication.

23. The multifunction smoke alarm unit according to claim 12 which utilizes said NFPA 72 National Fire Alarm code industry standard smoke alarm AC wiring to provide power for an integrated illumination source.

24. The multifunction smoke alarm unit according to claim 12 which utilizes the industry standard smoke alarm interconnect as a means to provide occupancy-based HVAC control for an entire multi-room building equipped with multiple multifunction smoke alarms.

25. The multifunction smoke alarm unit according to claim 7 which utilizes the industry standard smoke alarm interconnect to sound an intruder alarm from multiple locations throughout a building by propagating the intrusion alarm to all the other smoke alarms and/or multifunction smoke alarms which are also connected to said interconnect.

26. The multifunction smoke alarm unit according to claim 6 which functions as a smoke alarm and also turns off external lighting automatically after an area of a room becomes vacant for purposes of saving energy and or in order to comply with energy-saving mandates.

27. The multifunction smoke alarm unit according to claim 6 which further includes upgrade capabilities that provide improvements for security, energy saving, safety, and user convenience by controlling external lighting, HVAC systems, ceiling fans, ventilation systems, security alarms, and/or fire safety systems.

28. The multifunction smoke alarm unit according to claim 1 which utilizes NFPA 72 National Fire Alarm code industry standard smoke alarm installation locations for both detection of smoke/combustion and occupancy detector installation and occupancy detection without compromising operational performance of said occupancy sensor.

29. The multifunction smoke alarm unit according to claim 7 which can be controlled by a single control unit for purposes of arming the intruder alarm, disarming the security alarm, silencing the intruder alarm, and/or silencing a smoke alarm.

30. The multifunction smoke alarm unit according to claim 1 which utilizes a single audible alarm component to distinctively sound any of smoke alarms, intruder alarms, intruder alarm arm signals, intruder alarm disarm signals, visitor annunciation signals, vacancy warning signals, and or occupancy-based smoke alarm signals.

31. The multifunction smoke alarm unit according to claim 6 that further can detect and report the location of occupants to an external fire safety device or computer when a smoke alarm is sounded.

32. The multifunction smoke alarm unit according to claim 6 that further can detect and report the location of occupants as a distinctive audible sound when a smoke alarm is sounded.

33. A multifunction smoke alarm unit comprising:

a single enclosure that approximates the size of a smoke detector configured for installation on a ceiling or wall;

at least two separate sensors located within said single enclosure, wherein at least one of said sensors is a smoke or combustion detector, and at least one said sensors is an occupancy sensor;

one or more communication link(s) which can connect to at least one other smoke alarm unit, multifunction smoke alarm unit, network, computer network, external lighting, HVAC system, HVAC thermostat, ceiling fan, ventilation system, security alarm, and or fire safety system;

at least one audible warning device for notification of a combustion or a motion detection event;

functions as a smoke alarm in accordance with NFPA 72 National Fire Alarm code industry standard smoke alarm building codes, and functions as an intruder alarm, visitor annunciator, occupancy-based automatic night light with integrated illumination source, automatic security light controller, occupancy-based external lighting controller, occupancy-based HVAC system controller, occupancy-based ceiling fan controller, occupancy-based ventilation controller, and/or occupancy-based fire safety system controller.

* * * * *